US008213640B2

(12) United States Patent
Chalupper et al.

(10) Patent No.: US 8,213,640 B2
(45) Date of Patent: Jul. 3, 2012

(54) HEARING DEVICE FOR MUSICIANS

(75) Inventors: Josef Chalupper, Paunzhausen (DE); George Kobrick, Fürth (DE); Reinier Kortekaas, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1378 days.

(21) Appl. No.: 11/880,845

(22) Filed: Jul. 24, 2007

(65) Prior Publication Data

US 2008/0025536 A1 Jan. 31, 2008

(30) Foreign Application Priority Data

Jul. 28, 2006 (DE) ..... 10 2006 035 105

(51) Int. Cl.
*G10H 1/00* (2006.01)

(52) U.S. Cl. ..... 381/118; 381/74; 84/600; 84/611

(58) Field of Classification Search ..... 381/1–2, 381/6, 23.1, 309, 311, 74, 26, 87–91, 312, 381/314–315, 320–322, 118; 84/484, 470 R, 84/478, 477, 1, 600, 610–612, 634–636; 700/94

See application file for complete search history.

(56) References Cited

U.S. PATENT DOCUMENTS

| | | | | |
|---|---|---|---|---|
| 4,321,853 | A * | 3/1982 | Tumblin | 84/454 |
| 4,331,061 | A * | 5/1982 | Morgando | 84/470 R |
| 4,386,551 | A * | 6/1983 | Morgando | 84/470 R |
| 4,441,399 | A * | 4/1984 | Wiggins et al. | 84/470 R |
| 5,287,789 | A * | 2/1994 | Zimmerman | 84/477 R |
| 5,751,825 | A * | 5/1998 | Myers et al. | 381/118 |
| 6,714,233 | B2 * | 3/2004 | Chihara et al. | 348/14.02 |
| 7,465,867 | B2 * | 12/2008 | Glatt | 84/645 |
| 2002/0107556 | A1 | 8/2002 | McIoul et al. | |
| 2004/0000226 | A1 * | 1/2004 | Sakamoto | 84/611 |
| 2005/0281424 | A1 | 12/2005 | Rass | |
| 2007/0079692 | A1 | 4/2007 | Glatt | |
| 2008/0031475 | A1 * | 2/2008 | Goldstein | 381/151 |

FOREIGN PATENT DOCUMENTS

| | | | |
|---|---|---|---|
| DE | 7418832 | U | 10/1974 |
| DE | 3009414 | A1 | 9/1981 |
| DE | 103 45 173 | B3 | 1/2005 |
| DE | 102004025691 | B3 | 8/2005 |
| DE | 10 2005 012 975 | B3 | 8/2006 |
| EP | 1 615 468 | A1 | 1/2006 |
| JP | 2003-316354 | A | 11/2003 |
| JP | 2004-361910 | A | 12/2004 |
| JP | 2005-017995 | A | 1/2005 |

* cited by examiner

*Primary Examiner* — Vivian Chin
*Assistant Examiner* — Fatimat O Olaniran

(57) ABSTRACT

There is described a hearing device especially for musicians. For this purpose a hearing device is proposed, in whose housing a music device is integrated with which tones or signals can be emitted via the signal processor and the loudspeaker to the hearing device wearer. This music device can, for example, be a tuner with tone pitch analysis or sound playback, a metronome and/or a tone pitch processing unit. A remote control for receiving pieces of music and for playback via a hearing device may also be provided.

14 Claims, 1 Drawing Sheet

HEARING DEVICE FOR MUSICIANS

CROSS REFERENCE TO RELATED APPLICATIONS

This application claims priority of German application No. 10 2006 035 105.3 DE filed Jul. 28, 2006, which is incorporated by reference herein in its entirety.

FIELD OF INVENTION

The present invention relates to a hearing device comprising a signal processor, a loudspeaker, which is connected to the signal processor, and a housing in which the signal processor and loudspeaker are integrated. The present invention also relates to a corresponding hearing device with a remote control.

BACKGROUND OF INVENTION

In many cases musicians require a metronome and a tuner to play music. They are, moreover, sometimes helpful for what are known as in-ear monitoring systems with which for example corresponding sounds can be transmitted into the ear from an audiomixer on a stage. Musicians also often use sound recording and playback equipment.

There is a problem that some musicians who are hard of hearing have disturbed pitch perception between the two ears (diplacusis). This dysfunction affects their playing and enjoyment of music. Corresponding devices for tone pitch processing are not available on the market either, however.

A device is known from document JP 2005-017995 which is used for tuning a musical instrument. A detected signal is compared with a generated reference signal. The degree of correspondence between the two signals is acoustically communicated to the user, so he can dispense with a visual display.

Furthermore, a modular remote control unit for hearing aid devices is known from granted patent DE 103 45 173 B3. The remote control unit can be expanded by an expansion module which comprises a microphone with a sound entry aperture for receiving an acoustic input signal from the proximity of the remote control. The received audio signal can be wirelessly transmitted to a hearing aid device by means of the remote control. This is advantageous in noise-filled surroundings in order to bring the microphone as close as possible to the useful sound wave.

The additional document US 2004/0000226 A1 describes an electronic metronome. This metronome can be worn in the concha of a user. A loudspeaker therein generates a sound in the desired rhythm. Similar rhythm generators and tuners are also known from documents JP 2004-361910 A and JP 2003-316354 A.

SUMMARY OF INVENTION

An object of the present invention therefore lies in making music playing more convenient for hearing device wearers.

According to the invention this object is achieved by a hearing device comprising a signal processor, a loudspeaker, which is connected to the signal processor, and a housing in which the signal processor and loudspeaker are integrated, a tuner and/or metronome, with which tones or signals can be emitted to the hearing device wearer via the signal processor and the loudspeaker, also being integrated in the housing.

Furthermore, a hearing device is provided according to the invention comprising a signal processor, a loudspeaker, which is connected to the signal processor, a housing, in which the signal processor and loudspeaker are integrated, and a remote control for controlling the signal processor, a microphone and a storage medium being integrated in the remote control, with which sound signals can be stored and transmitted to the signal processor in the housing.

If the hearing device is equipped with a tuner or has a tuner function, the hearing device wearer who is playing music does not need to carry a separate tuner. If the hearing device comprises a metronome, the hearing device wearer benefits from the fact that he is already carrying an electronic device which is accordingly also used to achieve the function of a metronome.

The tuner can output a predetermined tone in response to operation of the hearing device. For example the hearing device can emit the standard pitch a.

The tuner can also comprise a sound analyzer with which a sound received by the hearing device can be analyzed with respect to tone pitch, with which the determined tone pitch can be compared with a tone of a scale from the music and from which a corresponding comparative signal can be emitted. The hearing device wearer thereby receives comprehensive help in tuning musical instruments.

The comparative result just mentioned can however also be acoustically transmitted electrically or electromagnetically via the hearing device to a remote control of the hearing device for visual display. Displaying the comparative result can thus be simplified or made more convenient.

The hearing device can also comprise a tone pitch processing unit. This means that the hearing device can also be used for defective pitch perception.

Specifically the following devices by way of example are available on the market:

1. Metronome with loudspeaker: one drawback of this is that there is no in-ear monitoring function and no tuner function and, in addition, the surroundings (other musicians, listeners) are disrupted.
2. Tuner with visual display: one drawback of this is that, again, there is no in-ear monitoring function and no metronome function and there is no acoustic response either.
3. Combination of tuner with visual display and a metronome with loudspeaker: one drawback of this is that the surroundings (other musicians, listeners) are disrupted and in-ear monitoring is not possible.
4. In-ear metronome: this device does not offer in-ear monitoring either or a tuner functionality.
5. In-ear monitoring: one drawback of this is that there is no tuner functionality and no metronome functionality either.
6. Hard disc or MP3 recorder: there is usually no metronome, tuner or in-ear monitoring device fitted in this equipment either.

There is currently no device for musicians on the market which provides tuner, metronome, in-ear monitoring and sound recording. Musicians who are hard of hearing are of course also confronted with this problem, especially since they also rely on a hearing device.

BRIEF DESCRIPTION OF THE DRAWINGS

The present invention will now be described in more detail with reference to the accompanying drawings, in which.

DETAILED DESCRIPTION OF INVENTION

The exemplary embodiments illustrated in more detail hereinafter are preferred embodiments of the present invention.

According to the invention a hearing device, preferably an in-the-ear hearing device which conventionally comprises a microphone, electrical and wireless inputs, a signal processor and a loudspeaker (earphone), is expanded by the functionality of metronome, tuner, in-ear monitoring, sound recording, and sound playback and/or tone pitch processing. The various functionalities can be permanently associated with different hearing device programs.

According to a first exemplary embodiment the hearing device is equipped with a tuner which constitutes said music device or which forms at least part of said music device. In a special case the function of the tuner is to generate a tuning tone. In particular this may be standard tone a in this connection (440 Hz). This tuning tone can preferably be configured or selected. A push button can be provided on the hearing device or its remote control to output the tuning tone. In response to the push of a button the hearing device outputs the tuning tone either for a fixed length or permanently, wherein it is switched off by a further push of a button.

Figure 1:
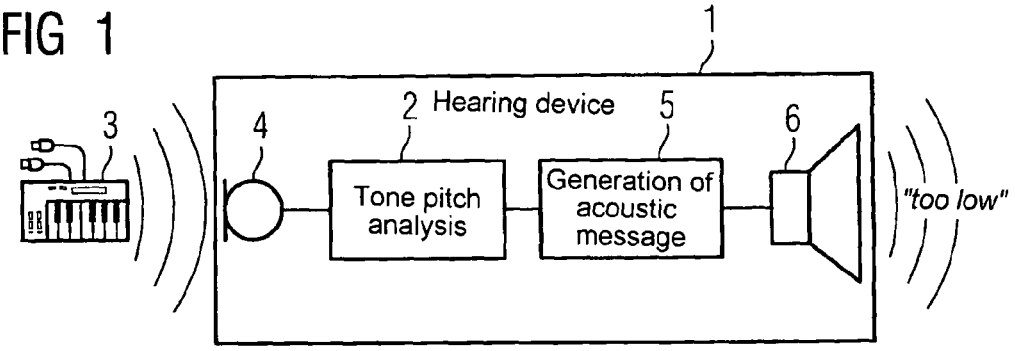
FIG. 1 shows a basic circuit diagram of a hearing device with a tone pitch analysis unit.

The tuner can however also be produced according to FIG. 1 in the hearing device 1 by an analysis unit 2. Using the analysis unit 2 it should be possible to directly analyze a musical instrument 3 for tuning. The musician plays the instrument 3 for this purpose. The sound produced by the musical instrument 3 is received by a microphone 4 internal to the hearing device and is passed on to the analysis unit 2. The sound can however also be wirelessly transmitted directly from the musical instrument 3 to the hearing device via a corresponding interface. Moreover it is possible for the sounds of the musical instrument to be received by a microphone of a hearing device remote control and be wirelessly transmitted from there to the hearing device. There is also the possibility of electrically feeding the output signals of the musical instrument 3 into an audio input of the hearing device 1.

The analysis unit 2, which can be integrated in the signal processor of the hearing device 1, analyzes the tone pitch and sends the result of analysis to a message generator 5. This generates an acoustic message for outputting to the hearing device wearer via a hearing device loudspeaker 6. The hearing device wearer receives for example the message "a1, too low".

In addition or alternatively the message can also be passed on to a remote control (not shown), so it can be visually perceived on the remote control.

Using the analysis unit the sound of the musical instrument 3 is thereby directly analyzed and the hearing device wearer receives a message which facilitates his tuning of the instrument 3.

In a further preferred embodiment the hearing device comprises a metronome as a music device. The clock of the microphone is advantageously adjusted via the volume or VC controller on the hearing device or via the hearing device remote control. Start and stop of the metronome take place for example via a hearing device program operating button. Specifically, a signal generator generates the pulse sequences typical for a metronome in the processor of the hearing device.

Figure 2:
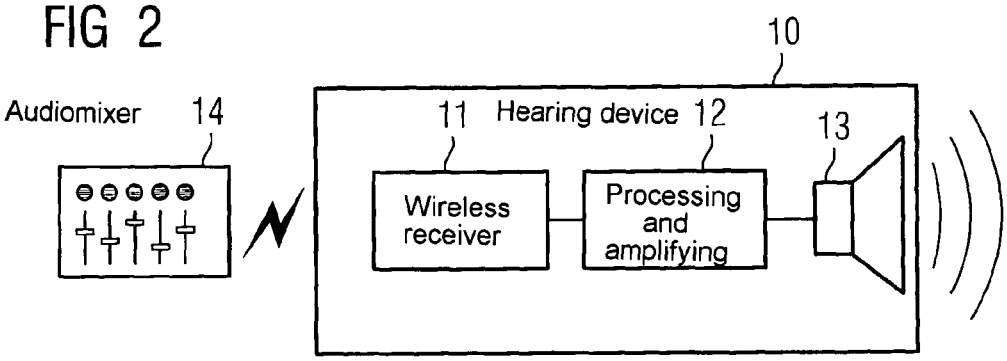
FIG. 2 shows a basic circuit diagram of a hearing device with which in-ear monitoring is possible.

FIG. 2 shows a hearing device 10 which in the illustrated simple embodiment cannot be claimed on its own but can be combined with all other exemplary embodiments. The hearing device 10 in FIG. 2 is thus equipped in a manner known per se with a wireless receiver 11 for wirelessly receiving signals. The output signals are processed in a signal processing unit 12 and amplified. The resulting signals are output via a loudspeaker 13 to the hearing device wearer. Electromagnetic signals for example can be received from an audiomixer 14 using the wireless receiver 11. Transmission from an audiomixer to a hearing device wearer is thus possible for example in a sound studio without other colleagues or devices being acoustically disturbed.

Figure 3:
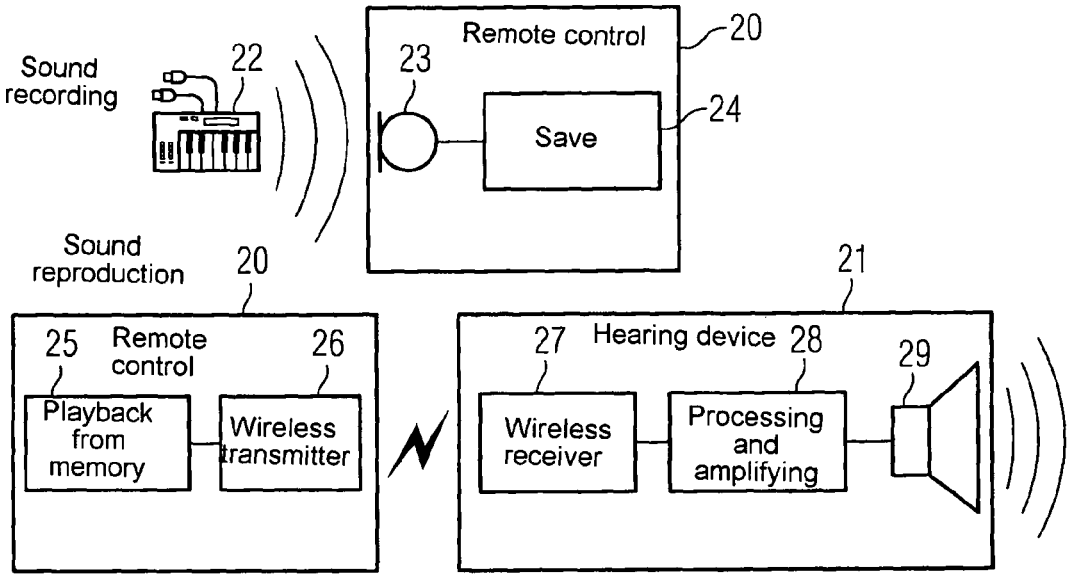
FIG. 3 shows a basic circuit diagram of a hearing device with a remote control for storing and playing back pieces of music.

According to a further exemplary embodiment outlined in FIG. 3 sound is recorded using a remote control 20 and correspondingly played back via the hearing device 21. A musician again plays a musical instrument 22. The sound of the music is received by a microphone 23 in the remote control 20. A storage medium 24 connected to the microphone 23 in the remote control 20 stores the music sound signals. For sound playback the remote control 20 also has a playback unit 25 and a wireless transmitter 26 connected thereto. The hearing device 21 itself is like that in FIG. 2, namely equipped with a wireless receiver 27 and a signal processing unit 28 and a loudspeaker 29.

When playing back the music signal stored in the remote control 20 this signal is wirelessly transmitted from the remote control 20 to the hearing device 21. The received signal is dealt with and processed like a conventional microphone signal in the hearing device. The musician can use a hearing device 21 of this kind with remote control 20 specifically for practice purposes in that he first of all receives the music played by him via the remote control 20 and then plays it back via his hearing device 21.

A further exemplary embodiment according to the invention relates to tone pitch processing. The hearing device is conventionally equipped with a microphone, a signal processing unit and a loudspeaker. A tone pitch processing unit specifically integrated in the signal processor or signal processing unit processes the received microphone signal with respect to the tone pitch. The tone pitch is thereby adjusted to the ear that is not provided with a hearing device. This functionality is basically independent of music applications and can be continually active in the hearing device.

The invention claimed is:

1. A hearing device, comprising: a signal processor; a loudspeaker connected to the signal processor; a housing, wherein the signal processor and the loudspeaker are integrated in the housing and wherein the housing is sized and shaped to be positioned in an ear of a hearing device wearer a tuner to emit tones or signals to the hearing device wearer via the signal processor and the loudspeaker, wherein the tuner is integrated in the housing;

wherein the tuner comprises a sound analyzer to analyze a sound received by the hearing device with respect to tone pitch, wherein the sound analyzer compares a determined tone pitch with a tone of a scale from music, and wherein the sound analyzer outputs a corresponding comparative result and a remote control for controlling the signal processor, wherein a microphone and a storage medium are integrated in the remote control.

2. The hearing device as claimed in claim 1, wherein the tuner outputs a predetermined tone in response to operation of the hearing device.

3. The hearing device as claimed in claim 1, wherein the comparative result is output to athe remote control of the hearing device for visual display.

4. The hearing device as claimed in claim 1, further comprising a tone pitch processing unit.

5. The hearing device as claimed in claim 1, wherein sound signals received by the microphone in the remote control are stored and transmitted to the signal processor in the housing of the hearing device.

6. A hearing device, comprising: a signal processor; a loudspeaker connected to the signal processor; a housing, wherein the signal processor and the loudspeaker are integrated in the housing and wherein the housing is sized and shaped to be positioned in an ear of a hearing device wearer;

a tuner wherein the tuner comprises a sound analyzer to analyze a sound received by the hearing device with respect to tone pitch, wherein the sound analyzer compares a determined tone pitch with a tone of a scale from music, and wherein the sound analyzer outputs a corresponding comparative result a remote control for controlling the signal processor; a microphone integrated in the remote control; and a storage medium to store sound signals integrated in the remote control, wherein sound signals received by the microphone in the remote control are transmitted to the signal processor in the housing of the hearing device.

7. The hearing device as claimed in claim 6, wherein the tuner is integrated in the hearing device, and wherein the tuner generates a tone of 440 Hz.

8. The hearing device as claimed in claim 6, wherein a metronome is integrated in the hearing device.

9. The hearing device as claimed in claim 7, wherein a metronome is integrated in the hearing device.

10. A hearing device, comprising:

a signal processor;

a loudspeaker connected to the signal processor;

a housing, wherein the signal processor and the loudspeaker are integrated in the housing and wherein the housing is sized and shaped to be positioned in an ear of a housing device wearer;

a metronome to emit tones or signals to the hearing device wearer via the signal processor and the loudspeaker, wherein the metronome is integrated in the housing; and a tuner comprising a sound analyzer to analyze a sound received by the hearing device with respect to tone pitch, wherein the sound analyzer compares a determined tone pitch with a tone of a scale from music, and wherein the sound analyzer outputs a corresponding comparative result to a remote control of the hearing device for visual display.

11. The hearing device as claimed in claim 10, further comprising a tone pitch processing unit.

12. The hearing device as claimed in claim 11, wherein the remote control is for controlling the signal processor.

13. The hearing device as claimed in claim 12, wherein a microphone and a storage medium are integrated in the remote control.

14. The hearing device as claimed in claim 13, wherein sound signals received by the microphone in the remote control are stored and transmitted to the signal processor in the housing of the hearing device.

* * * * *

UNITED STATES PATENT AND TRADEMARK OFFICE

CERTIFICATE OF CORRECTION

PATENT NO. : 8,213,640 B2
APPLICATION NO. : 11/880845
DATED : July 3, 2012
INVENTOR(S) : Josef Chalupper, George Kobrick and Reinier Kortekaas It is certified that error appears in the above-identified patent and that said Letters Patent is hereby corrected as shown below:

Col. 5, line 2, claim 3, remove [a].

Signed and Sealed this
Eleventh Day of December, 2012

David J. Kappos
*Director of the United States Patent and Trademark Office*